US011066932B2

(12) United States Patent
Hoffmann

(10) Patent No.: US 11,066,932 B2
(45) Date of Patent: Jul. 20, 2021

(54) ACTUATING CYLINDER FOR A HYDROSTATIC AXIAL PISTON MACHINE AND HYDROSTATIC AXIAL PISTON MACHINE WITH AN ACTUATING CYLINDER

(71) Applicant: Robert Bosch GmbH, Stuttgart (DE)

(72) Inventor: Felix Hoffmann, Tuebingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/902,933

(22) Filed: Jun. 16, 2020

(65) Prior Publication Data

US 2020/0408095 A1 Dec. 31, 2020

(30) Foreign Application Priority Data

Jun. 26, 2019 (DE) ..... 10 2019 209 261.6

(51) Int. Cl.
*F01B 3/10* (2006.01)

(52) U.S. Cl.
CPC ..... *F01B 3/102* (2013.01); *F01B 3/106* (2013.01)

(58) Field of Classification Search
CPC ..... F01B 3/106; F01B 3/102
See application file for complete search history.

(56) References Cited

U.S. PATENT DOCUMENTS 1,876,024 A * 9/1932 Rosenberry ..... B66F 3/26 91/401
3,955,475 A * 5/1976 Horiuchi ..... F01B 3/0064 91/499
4,240,326 A * 12/1980 Carle ..... F01P 3/00 91/39
4,437,387 A * 3/1984 Beck ..... F15B 11/205 91/189 R
6,725,658 B1 * 4/2004 Lemmen ..... F04B 1/324 60/443

FOREIGN PATENT DOCUMENTS

EP 1 220 990 B1 7/2002
EP 2 410 179 B1 1/2012

* cited by examiner

*Primary Examiner* — F Daniel Lopez
(74) *Attorney, Agent, or Firm* — Maginot, Moore & Beck LLP

(57) ABSTRACT

An actuating cylinder for an adjustment apparatus of a pivot angle of a hydrostatic axial piston machine has a hydraulic stop which connects an actuating pressure chamber of the actuating cylinder to an interior of the housing of the axial piston machine if the actuating piston is maximally extended. To this end, a channel is provided on the actuating piston side, while a control edge is provided on the housing side. The control edge is formed at the interface of a stop bore with the actuating cylinder bore. The stop bore may also be a leakage bore of the axial piston machine.

8 Claims, 2 Drawing Sheets

ACTUATING CYLINDER FOR A HYDROSTATIC AXIAL PISTON MACHINE AND HYDROSTATIC AXIAL PISTON MACHINE WITH AN ACTUATING CYLINDER

This application claims priority under 35 U.S.C. § 119 to application no. DE 10 2019 209 261.6, filed on Jun. 26, 2019 in Germany, the disclosure of which is incorporated herein by reference in its entirety.

The disclosure relates to an actuating cylinder for adjusting the stroke volume of a hydrostatic axial piston machine and a hydrostatic axial piston machine with such an actuating cylinder.

BACKGROUND

In the case of hydrostatic axial piston machines (pumps or motors), it is known to adjust the stroke volume (conveying volume or displacement volume) via actuating cylinders. The actuating cylinder has, for this purpose, an actuating piston which is coupled to a swash plate or pivot cradle of the axial piston machine with an adjustable inclination. When actuating pressure medium acts on the actuating cylinder, the actuating piston is moved out of the actuating cylinder and pivots the pivot cradle (back) in the direction of a small stroke volume. It is known here to restrict the reverse pivoting movement by a stop for the actuating piston.

Publication EP 2 410 179 B1 shows an axial piston machine with an actuating cylinder, for the actuating piston of which such a stop is provided. The stop is of mechanical design and adjustable.

EP 1 220 990 B1 discloses an axial piston machine with a stop for the actuating piston which is of hydraulic design. To this end, the actuating pressure chamber of the actuating cylinder is connected to an annular groove via an interior, belonging to the actuating pressure chamber, of the actuating piston and via a radial channel, which annular groove is formed on the outer circumference of the actuating piston. In the case of a predetermined extended position of the actuating piston, a connection opens from the actuating pressure chamber via the annular groove to the interior of the housing of the axial piston machine. The actuating piston is thus pressure-equalized and its extension movement is stopped.

A housing-fixed edge which defines the stop if the annular groove of the actuating piston reaches it is formed to realize such a hydraulic stop.

The outlay in terms of production engineering in the case of the precise manufacture of the edge which defines the stop is disadvantageous in such actuating cylinders for axial piston machines.

SUMMARY

Against this background, the object on which the disclosure is based is to create an actuating cylinder for axial piston machines which has a hydraulic stop for the actuating piston, and the (idle) edge of which can be easily produced and precisely positioned. A further object of the disclosure is to create an axial piston machine with such an actuating cylinder.

This object is achieved in terms of the actuating cylinder and of the axial piston machine by the combination of features disclosed herein.

Further advantageous configurations of the actuating cylinder and axial piston machine are also described herein.

The disclosed actuating cylinder serves to adjust a stroke volume of a hydrostatic axial piston machine. The actuating cylinder has an actuating cylinder bore which is incorporated into what is known as a main component. An actuating piston is guided movably in the actuating cylinder bore. The actuating piston delimits an actuating pressure chamber and can be coupled to a swash plate or pivot cradle of the axial piston machine. The actuating cylinder has a hydraulic stop for the actuating piston. At the stop, the actuating pressure chamber is connected to a surrounding area of the actuating cylinder via at least one channel. According to the disclosure, the hydraulic stop has a stop bore also formed in the main component, which stop bore intersects with the actuating cylinder bore and as a result forms an edge. The channel can be made to open (initially to the stop bore) via this edge if the actuating piston reaches the stop.

The stop bore is preferably inclined obliquely with respect to the actuating cylinder bore. If e.g. the actuating cylinder bore is arranged obliquely with respect to a shaft longitudinal axis of the relevant axial piston machine, a bore longitudinal axis of the stop bore can be perpendicular to the shaft longitudinal axis, e.g. without intersecting with it.

The stop bore and the actuating cylinder bore are preferably formed by machining.

If the actuating piston is a hollow piston, the interior of which forms a part of the actuating pressure chamber, the channel is preferably formed in the actuating piston. This preferably occurs easily in terms of production engineering as a radial channel.

If the hydraulic stop has a circumferential groove formed on the outer circumference of the actuating piston, into which circumferential groove the at least one channel opens, assembly is simplified and potential later rotation of the actuating piston is not critical.

The axial piston machine according to the disclosure has an actuating cylinder previously described. The actuating piston is coupled to the swash plate of the axial piston machine. The stop bore and the actuating cylinder bore are formed in or on a housing of the axial piston machine which forms the main component of the actuating cylinder. This axial piston machine also achieves the above-mentioned object since its (idle) edge formed on the housing for the hydraulic stop is easy to produce and can be precisely positioned.

It is easy in terms of production engineering if the stop bore is a through-bore which penetrates through the housing.

Synergies can be exploited if the through-bore is simultaneously a leakage bore. The surrounding area of the actuating cylinder is then an interior of the housing which is connected or can be connected to an outside of the axial piston machine via the leakage bore.

The stop bore can advantageously be closed with a stopper or closure, in particular with a secure screw closure.

BRIEF DESCRIPTION OF THE DRAWINGS

Several exemplary embodiments of an axial piston machine according to the disclosure are represented in the figures.

In the figures.

DETAILED DESCRIPTION

Figure 1:
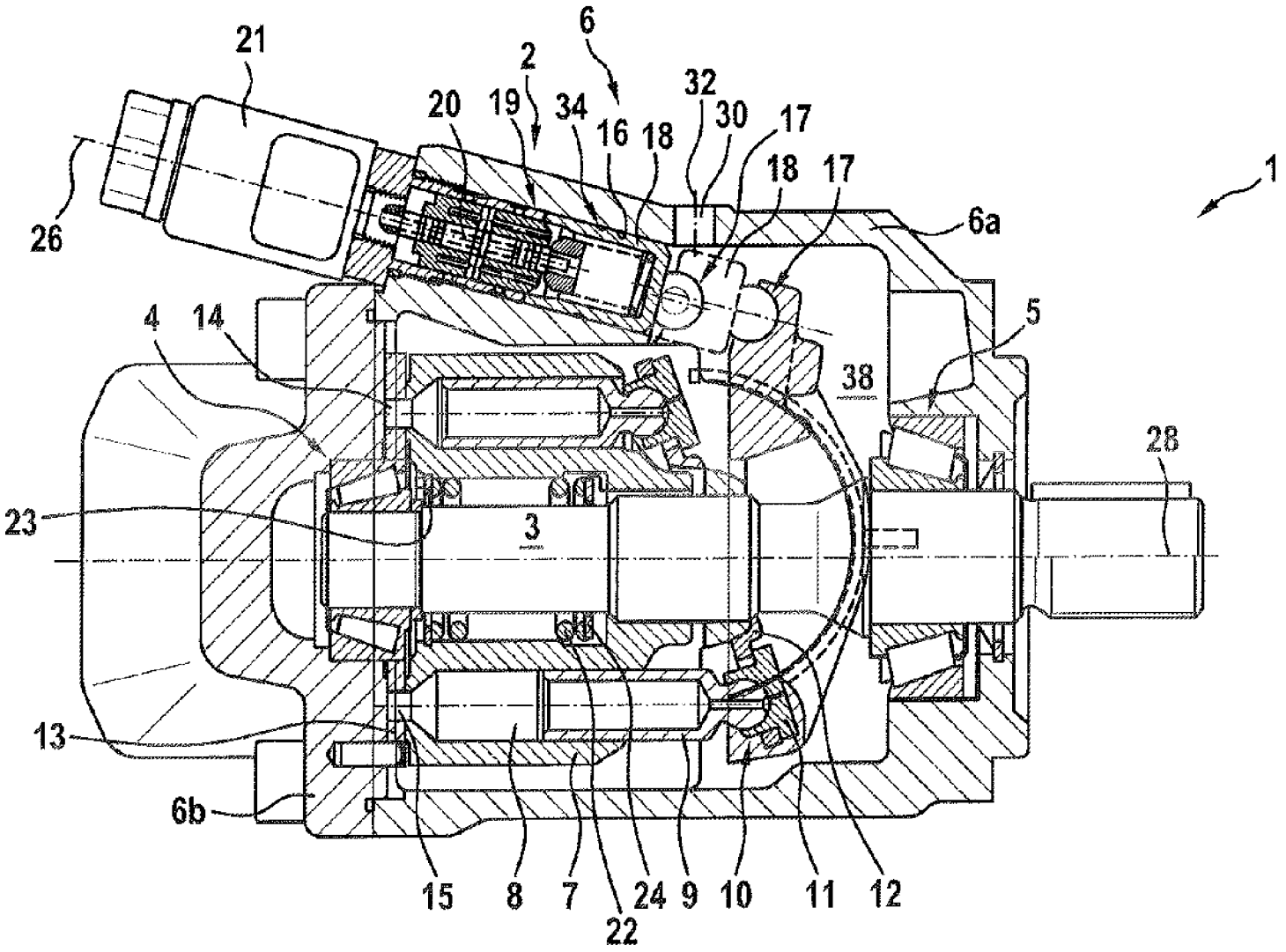
FIG. 1 shows, in a longitudinal section, the axial piston machine according to the disclosure according to a first exemplary embodiment while omitting a closure screw.

FIG. 1 shows an axial section through an axial piston machine 1 of swash plate design. A shaft 3 is rotatably mounted on a first bearing 4 and a second bearing 5 in a housing 6 of axial piston machine 1. Housing 6 is divided into a base body 6*a* and a cover body 6*b* screwed to base body 6*a*. A cylinder drum 7 is connected to shaft 3 in a rotationally conjoint manner. Cylinder bores 8 arranged on a partial circle are located therein, in which cylinder bores 8 pistons 9 are axially displaceable. Pistons 9 are connected via ball joints 10 to respective sliding blocks 11 and are supported via sliding blocks 11 on a swash plate 12 formed as a pivot cradle.

The connection of cylinder bores 8 to a high-pressure line and to a low-pressure line (both not shown) is carried out via a control body 13 which has a kidney-shaped high-pressure opening 14 and a likewise kidney-shaped low-pressure opening 15.

Cylinder drum 7 is held bearing against control body 13 by means of a spring 22. To this end, spring 22 is supported via a first ring on cylinder drum 7 and via a second ring 24 on shaft 3. Cylinder drum 7 can be moved axially with respect to shaft 3 via a key-and-slot connection.

The stroke of pistons 9 in cylinder bores 8 is defined by a pivot angle $\alpha$ of swash plate 12. Swash plate 12 is represented in FIG. 1 in its neutral position and twice in a position pivoted by pivot angle $\alpha$.

An adjusting device 2 serves to pivot swash plate 12. It is largely integrated into a receiving bore or cylinder bore 16 of housing 6 and is composed of an actuating piston 18 which is connected via a ball joint connection 17 to swash plate 12 and is guided axially in cylinder bore 16 and a control valve 19 inserted into cylinder bore 16 and an actuating member 21 which defines a control force for a valve piston 20 of control valve 19. Control valve 19 and actuating piston 18 are arranged axially offset to one another in cylinder bore 16.

Actuating cylinder bore 16 has a longitudinal axis 26 which is inclined at an angle <45° to a shaft longitudinal axis 28. A leakage bore 30 is provided in base body 6*a* of housing 6, which leakage bore 30 penetrates through a wall of base body 6*a*. A bore axis 32 of leakage bore 30 is preferably arranged perpendicular to shaft longitudinal axis 28 and, however, runs preferably spaced apart from shaft longitudinal axis 28.

In particular, however, bore longitudinal axis 32 intersects with longitudinal axis 26 of actuating cylinder bore 16 at an angle between 45° and 135°. According to the disclosure, leakage bore 30 is positioned along longitudinal axis 26 of actuating cylinder bore 16 such that it forms a hydraulic stop for actuating piston 18 in the extended position (also shown in FIG. 1), in which position pivot angle $\alpha$ is minimal. Leakage bore 30 is thus also used according to the disclosure as what is known as stop bore 30. If, during operation of the axial piston machine according to the disclosure, a circumferential groove 34 formed on the outer circumference of actuating piston 18 reaches the edge (bottom left in FIG. 1) of stop bore 30, an interior of actuating piston 18, which is connected directly to an actuating pressure chamber 36 or even largely forms it, is relieved of pressure toward an interior 38 of housing 6. A further extension movement of the actuating piston is thus prevented independently of the supplied actuating pressure medium.

Figure 2:
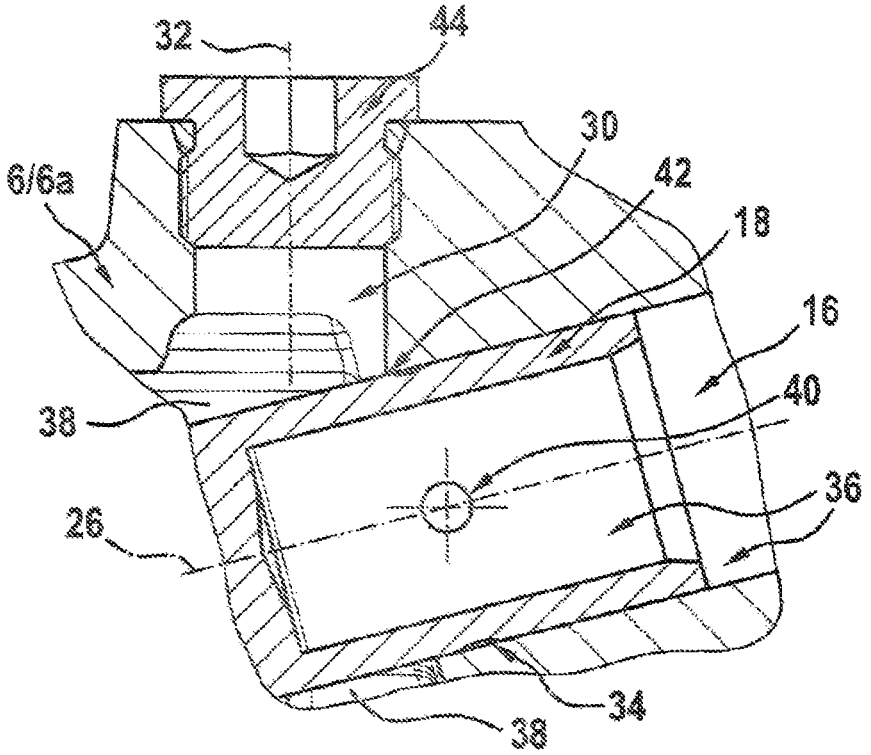
FIG. 2 shows an enlarged cut-out of the axial piston machine according to the disclosure according to a second exemplary embodiment with actuating piston and closure screw.

FIG. 2 shows the cut-out of the axial piston machine according to the disclosure with the hydraulic stop according to a second exemplary embodiment. The exemplary embodiment only has slight changes in comparison with the first exemplary embodiment according to FIG. 1 and is a mirror-image of the representation from FIG. 1.

When pivoting back the pivot cradle (not shown), actuating piston 18 moves (to the left in FIG. 2) and is shown in FIG. 2 in a position immediately before the response of the hydraulic stop. The interior of actuating piston 18 and actuating pressure chamber 36 are acted upon with actuating pressure medium which escapes into interior 38 of housing 6 upon response of the hydraulic stop. This occurs on a flow path through one or more channels 40 formed as radial bores and via circumferential groove 34 and via stop bore 30 which is simultaneously used as leakage bore 30. In this case, an edge 42 serves as a control edge which is only apparent in FIG. 2 as a corner and which is only formed by the introduction of the two intersecting bores 16, 30.

The production outlay of this hydraulic stop is in particular very small if a leakage bore 30 provided in any event is only positioned such that it forms edge 42 together with actuating cylinder bore 16 at a predetermined point. After the production of stop bore 30 by machining, a thread is also provided therein so that a closure formed as a closure screw can be inserted there in a sealing manner.

Figure 3:
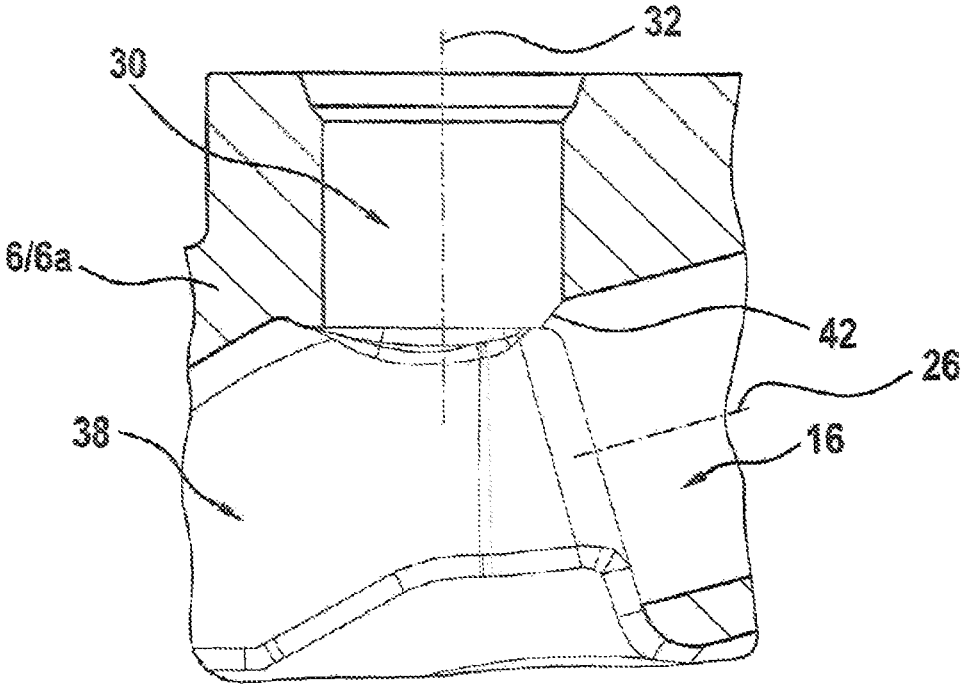
FIG. 3 shows the cut-out from FIG. 2 while omitting the actuating piston and the closure screw.

FIG. 3 shows the hydraulic stop of the axial piston machine according to FIG. 2, wherein closure screw 44 and actuating piston 18 were omitted. It is clearly apparent that actuating cylinder bore 16 and stop or leakage bore 30 are introduced at an angle <90° to one another into housing 6 or base body 6*a*. Here, the two bores 16, 30 form arcuate edge 42 which serves as a control edge, of which only the half lying below the drawing plane is apparent in FIG. 3.

An actuating cylinder for an adjusting apparatus of a pivot angle of a hydrostatic axial piston machine is disclosed. The actuating cylinder has a hydraulic stop which connects an actuating pressure chamber of the actuating cylinder to an interior of the housing of the axial piston machine if the actuating piston is maximally extended. To this end, a channel is provided on the actuating piston side, while a control edge is provided on the housing side. The control edge is formed at the interface of a stop bore with the actuating cylinder bore. It is particularly preferred if the stop bore is also a leakage bore of the axial piston machine.

LIST OF REFERENCE NUMBERS

1 Axial piston machine
2 Adjusting device
3 Shaft
4 Bearing
5 Bearing
6 Housing
6*a* Base body
6*b* Cover body
7 Cylinder drum
8 Cylinder bore
9 Piston
10 Ball joint
11 Sliding block
12 Swash plate
13 Control body
14 High-pressure opening
15 Low-pressure opening
16 Actuating cylinder bore
17 Ball joint connection

18 Actuating piston
19 Control valve
20 Valve piston
21 Actuating member
22 Spring
23 Ring
24 Ring
26 Longitudinal axis
28 Shaft longitudinal axis
30 Leakage bore/stop bore
32 Bore longitudinal axis
34 Circumferential groove
36 Actuating pressure chamber
38 Interior
40 Channel
42 Edge
44 Closure
α Pivot angle

The invention claimed is:

1. A hydrostatic axial piston machine with an actuating cylinder for adjusting a stroke volume of the hydrostatic axial piston machine, comprising:

an actuating cylinder bore defined in a main component of the hydrostatic axial piston machine; and an actuating piston movably guided in the actuating cylinder bore, the actuating piston defining an actuating pressure chamber, the actuating piston having a hydraulic stop for the actuating piston at which the actuating pressure chamber is connected via at least one channel to an interior of the main component, the hydraulic stop including a stop bore defined in the main component and which forms, together with the actuating cylinder bore, an edge via which the at least one channel is opened, wherein the stop bore is configured to connect the interior of the main component to an outside of the main component.

2. The hydrostatic axial piston machine according to claim 1, wherein the stop bore is inclined obliquely with respect to the actuating cylinder bore.

3. The hydrostatic axial piston machine according to claim 1, wherein the stop bore and the actuating cylinder bore are formed by machining.

4. The hydrostatic axial piston machine according to claim 1, wherein:

the actuating piston is a hollow piston having an interior which defines a part of the actuating pressure chamber, and the at least one channel is defined in the actuating piston.

5. The hydrostatic axial piston machine according to claim 1, wherein the hydraulic stop has a circumferential groove formed on an outer circumference of the actuating piston and into which the at least one channel opens.

6. An axial piston machine comprising:

a housing;

a swash plate located within the housing; and an actuating cylinder comprising:

an actuating cylinder bore defined in the housing; and an actuating piston coupled to the swash plate and movably guided in the actuating cylinder bore, the actuating piston defining an actuating pressure chamber, the actuating piston having a hydraulic stop for the actuating piston at which the actuating pressure chamber is connected via at least one channel to an interior of the housing, the hydraulic stop including a stop bore defined in the housing and which forms, together with the actuating cylinder bore, an edge via which the at least one channel is opened, wherein the stop bore extends from the interior of the housing to an outside of the axial piston machine.

7. The axial piston machine according to claim 6, wherein the stop bore is configured to be closed with a closure.

8. The axial position machine according to claim 7, wherein the closure is a closure screw.

* * * * *